US007006003B2

(12) United States Patent
Zimmerman et al.

(10) Patent No.: US 7,006,003 B2
(45) Date of Patent: Feb. 28, 2006

(54) MULTI-CANDELA EMERGENCY STROBE LIGHT

(75) Inventors: Larry A. Zimmerman, Carlisle, MA (US); Anthony J. Capowski, Westford, MA (US)

(73) Assignee: SimplexGrinnell LP, Westminster, MA (US)

( * ) Notice: Subject to any disclaimer, the term of this patent is extended or adjusted under 35 U.S.C. 154(b) by 128 days.

(21) Appl. No.: 10/645,396

(22) Filed: Aug. 21, 2003

(65) Prior Publication Data

US 2004/0056773 A1 Mar. 25, 2004

Related U.S. Application Data

(60) Provisional application No. 60/405,685, filed on Aug. 22, 2002.

(51) Int. Cl.
*G08B 5/00* (2006.01)

(52) U.S. Cl. ..... 340/815.4; 340/293; 340/331; 340/815.73; 396/164

(58) Field of Classification Search ..... 340/293, 340/294, 331, 393.3, 815.4, 815.73; 73/323, 73/327; 362/802; 396/164
See application file for complete search history.

(56) References Cited

U.S. PATENT DOCUMENTS

| | | | | |
|---|---|---|---|---|
| T0,103,802 | I4 * | 1/1984 | Rinaldi | 359/440 |
| 4,768,926 | A * | 9/1988 | Gilbert, Jr. | 416/61 |
| 5,335,153 | A * | 8/1994 | Kubota | 362/240 |
| 6,243,001 | B1 * | 6/2001 | Kodaka | 340/326 |
| 6,281,789 | B1 * | 8/2001 | Furtado et al. | 340/506 |
| 6,311,021 | B1 | 10/2001 | Kosich | |
| 6,411,201 | B1 * | 6/2002 | Hur et al. | 340/332 |
| 6,522,261 | B1 | 2/2003 | Scheffler et al. | |
| 6,556,132 | B1 * | 4/2003 | Pattok et al. | 340/331 |
| 6,833,783 | B1 * | 12/2004 | Ha et al. | 340/293 |

OTHER PUBLICATIONS

Siemens Engineer and Architect Specifications for Adaptor™ Stand Alone Selectable Strobe, Aug. 2003, Cat. #2550 retrieved from http://www.sbt.siemens.com/FIS/product-doc/catalogs/2550.pdf.*

American Security Equipment Company (AMSECO), Product Specification for Select-A-Horn, Series HW-24 Horn.

NFPA Journal, Mar./Apr. 1999 Issue, Advertisement for Select-A-Strobe Product Line, Select-A-Horn.

* cited by examiner

*Primary Examiner*—Daniel Wu
*Assistant Examiner*—Samuel J. Walk

(57) ABSTRACT

A jumper, by its insertion at a particular position of a circuit board, selects one of plural strobe intensities. The jumper includes a flag listing available strobe intensity values. The flag is seated in a pocket when the jumper is inserted onto the circuit board, one face of said pocket comprising a viewing slot. The selected strobe intensity value on the jumper flag is observable through the viewing slot during normal operation of the visual notification appliance.

29 Claims, 7 Drawing Sheets

MULTI-CANDELA EMERGENCY STROBE LIGHT

RELATED APPLICATION

This application claims the benefit of U.S. Provisional Application No. 60/405,685, filed Aug. 22, 2002. The entire teachings of the above application are incorporated herein by reference.

BACKGROUND

Warning lights, i.e., visual notification appliances, are often used within buildings in conjunction with audio warning alarms so that the hearing impaired can be alerted to emergency conditions such as a fire. Typically, the warning light includes a flashing bulb positioned horizontally or vertically within a reflector. The bulb receives power from a power supply in a control panel. This power supply is normally powered by the building's AC supply, but also provides battery backup to ensure that the warning light will have power in the event power to the building is disrupted.

Warning lights are subject to light intensity requirements as specified in various standards, such as Underwriters Laboratories UL 1971 (as well as UL 1638), "Standard for Safety Signalling Devices for the Hearing Impaired," and the National Fire Protection Association's NFPA 72, *The National Fire Alarm Code*, all of which are incorporated herein by reference in their entirety.

The required intensity of the strobe, measured in candela, is dependent on occupancy, location, and local and national codes, standards and guidelines. For example, a strobe that is in a sleeping area and is required to wake the occupants is required to put out more candela than a strobe located in a hallway.

U.S. Pat. No. 6,411,201 to Hur et al., describes a notification appliance that provides multiple candela settings. A "menu" on the device provides the available strobe intensity settings. An installer can select a setting by positioning an actuator such that the actuator indicates the selection. The actuator engages a selector switch so that lateral movement of the actuator is translated to the selector switch.

SUMMARY OF THE INVENTION

Since each unit can be configured for the desired strobe intensity output, on-site inventory can be minimized and changes encountered during construction can be easily accommodated. However, for a unit that is relatively inexpensive to build, it is critical when adding a new feature, such as the availability of selecting one of plural strobe intensities, that the costs of adding the new feature be kept to a minimum. In addition to being inexpensive, the present invention offers a reliable means for providing the multi-candela option. That is, the jumper of the present invention is expected to be less expensive and less susceptible to breakage than an actuator/switch.

According to an embodiment of the invention, a visual notification appliance includes a jumper and a viewing slot. The jumper, by its insertion at a particular position of a circuit board within the appliance, selects one of the strobe intensities that are provided by the appliance. The jumper is inscribed (i.e., imprinted, engraved, etched, stamped or the like) with a list of the available strobe intensity values. The value of the selected strobe intensity, as a result of the position into which the jumper has been inserted, is observable through the view slot during normal operation of the visual notification appliance, e.g., after installation and mounting on a wall or ceiling.

In one embodiment, the jumper includes a flag portion on which the list of available strobe intensity values is inscribed. Upon insertion of the jumper onto the circuit board, the flag portion seats into a pocket, one face of which defines the viewing slot.

A cover or escutcheon may have a dimple through which the viewing slot can be viewed. Preferably, the dimple is displaced from the viewing slot such that the selected strobe intensity value on the jumper flag is observable through the viewing slot when viewed from an angle. For example, on a wall mounting appliance, the dimple may be vertically displaced below the viewing slot by about ⅛" to ¼" so that the selected value is observable to an inspector looking up at the appliance.

To help the installer identify the location at which the jumper should be inserted in order to select a desired strobe intensity, in one embodiment, the jumper also includes a pointer portion which, when the jumper has been inserted, indicates the selected strobe intensity from a list printed on the circuit board.

Preferably, the jumper is located such that it cannot be tampered with without removing the notification appliance from its mounting. For example, it may be accessible to an installer at the back of the appliance, which is normally not accessible once the appliance has been mounted.

In other embodiments, a jumper, by insertion at a particular position of a circuit board, selects one of plural strobe intensities, and a selection indicator, which is observable during normal operation of the visual notification appliance, indicates the value of the selected strobe intensity.

For example, the list of available strobe intensity values may be fixed on the escutcheon or another off-jumper location. When the jumper has been inserted, a pointer on the jumper, i.e., the selection indicator, points to an indication of the selected strobe intensity.

In various embodiments, the selection indicator becomes active when the strobe is activated, and/or when power is applied to the appliance, and/or upon a command. For example, the selection indicator can be an audible device, such as a horn or speaker, which audibly identifies the selected intensity, for example by sounding a horn or bell, or by enunciation of a recorded or synthesized voice or some other predefined sound.

In another embodiment, the selection indicator consists of one or more lamps that visually identify the selected intensity, for example using pulse-coding, binary coding and color coding, or some combination thereof, to identify the selected intensity. The lamps can be, for example, discrete LEDs, or bar graph or multi-segment displays.

In another embodiment, the selection indicator comprises a coded component such as a color-coded (e.g., painted) or marked resistor or other electronic or mechanical component that can be manually inserted.

In one embodiment, the visual notification appliance is addressable and can receive commands over the wires that power it.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1A:
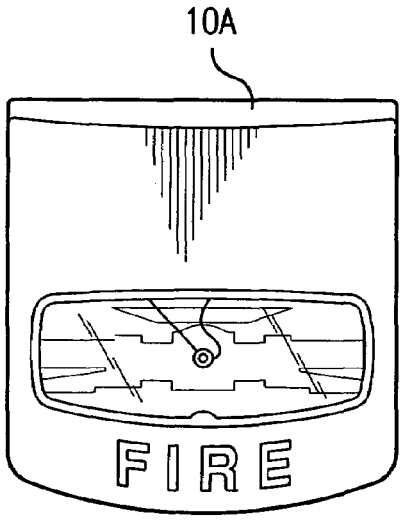
FIGS. 1A–1D are illustrations showing an assortment of different types of notification appliances that implement an embodiment of the present invention.
Figure 1B:
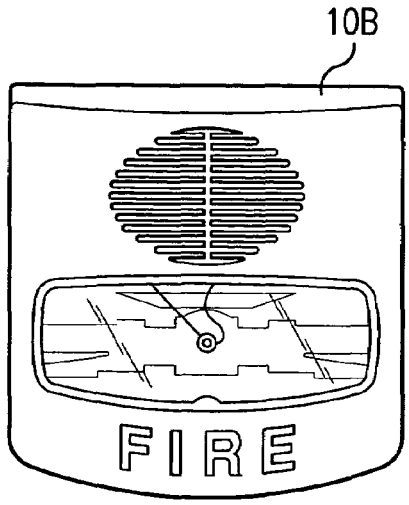
Figure 1C:
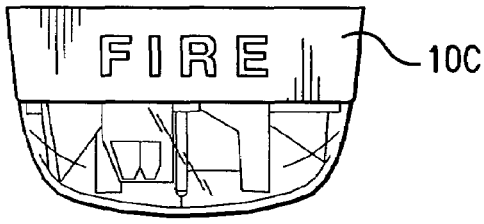
Figure 1D:
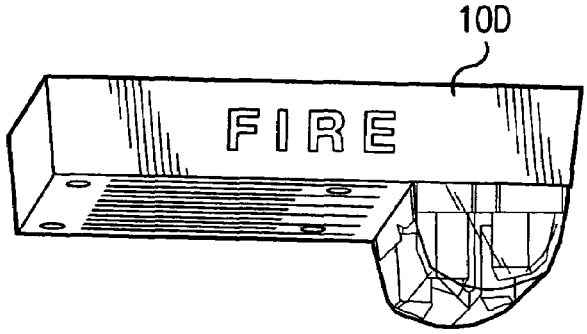

FIGS. 1A–1D are illustrations showing an assortment of different types of notification appliances that implement an embodiment of the present invention. The notification appliance 10A of FIG. 1A is strobe-only and is intended for wall-mounting. The notification appliance 10B of FIG. 1B, also intended for wall-mounting, additionally has a horn or speaker for enunciating an audible alarm. The notification appliance 10C of FIG. 1C is a strobe-only, ceiling-mount unit, while the notification appliance 10D of FIG. 1D, also a ceiling-mount unit, includes an audible alarm.

Figure 2:
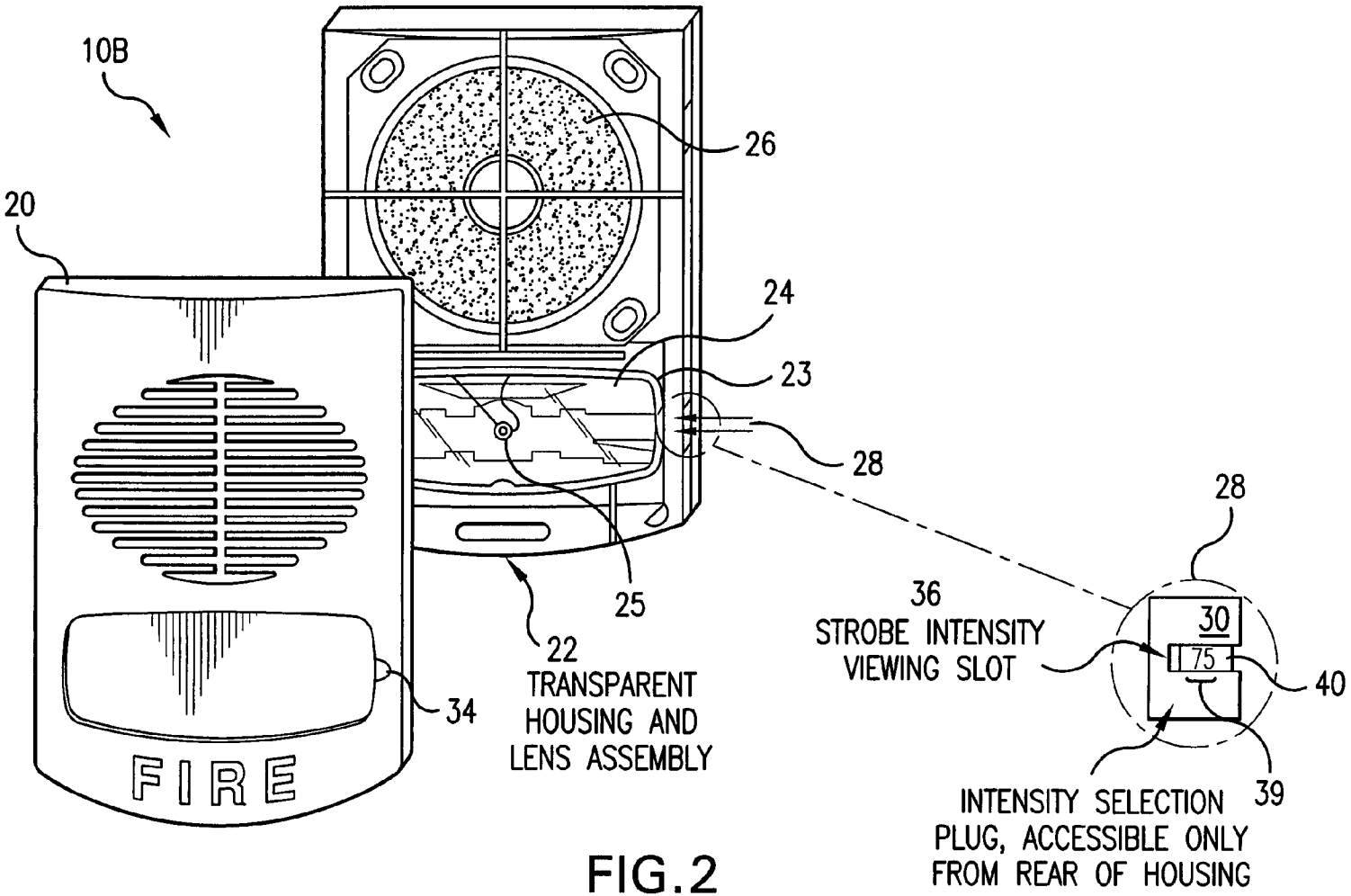
FIG. 2 is a drawing illustrating for exemplary purposes certain components of the notification appliance of FIG. 1B.

FIG. 2 is a drawing illustrating for exemplary purposes certain components of the notification appliance 10B of FIG. 1B. A removable cover or escutcheon 20 fits over a transparent housing 22, which includes dome 23. A reflector 24, positioned behind the dome 23, directs light from the bulb 25 in certain directions. In the illustrated notification appliance 10B, a speaker 26 produces an audible warning. The speaker 26 is not required, but is merely shown for exemplary purposes.

Toward one side of the dome 23 is a viewing section 28. A viewing dimple 34 in the escutcheon 20 allows an installer, inspector or other viewer to verify the current strobe intensity selection 39, in this example 75 candela, through a strobe intensity viewing slot 36. The viewing slot 36 is formed on a front portion 30 of a pocket in which the flag of the intensity selection plug 40 sits when installed. The viewing dimple 34 may be offset (vertically in this wall-mounting example) from the slot 36 so that a viewer standing below the appliance 10B and looking upward would have a direct line of sight to the slot 36 and the selection 39.

Figure 3A:
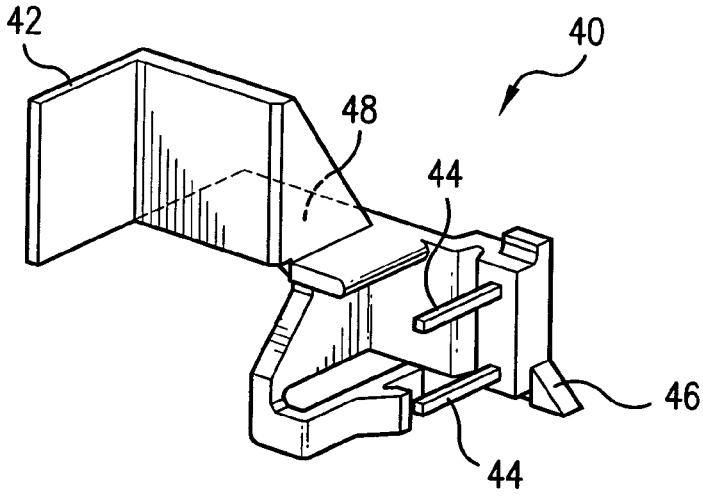
FIGS. 3A and 3B are mechanical drawings of the intensity selection plug of FIG. 2.
Figure 3B:
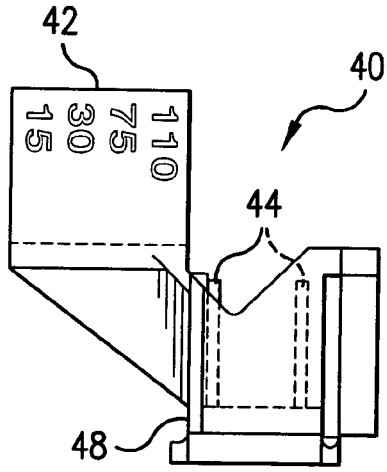

FIGS. 3A and 3B are mechanical drawings of the intensity selection plug 40 of FIG. 2. The plug 40 includes jumper pins 44 that, when inserted into various pairs of receptacles, cause the selection of a specific intensity. The plug 40 also includes a flag 42 that lists the available intensity settings. When the plug 40 is installed, the flag 42 is seated in a pocket 30 (FIG. 2), and only the selected setting is visible through the slot 36 (FIG. 2).

In the illustrated embodiment, the plug 40 includes a handle 48 that allows easy handling of the plug 40. For ease of installation, as will be seen in FIG. 5, pointer 46 aids an installer in placing the plug 40 in order to select the desired intensity.

Figure 4:
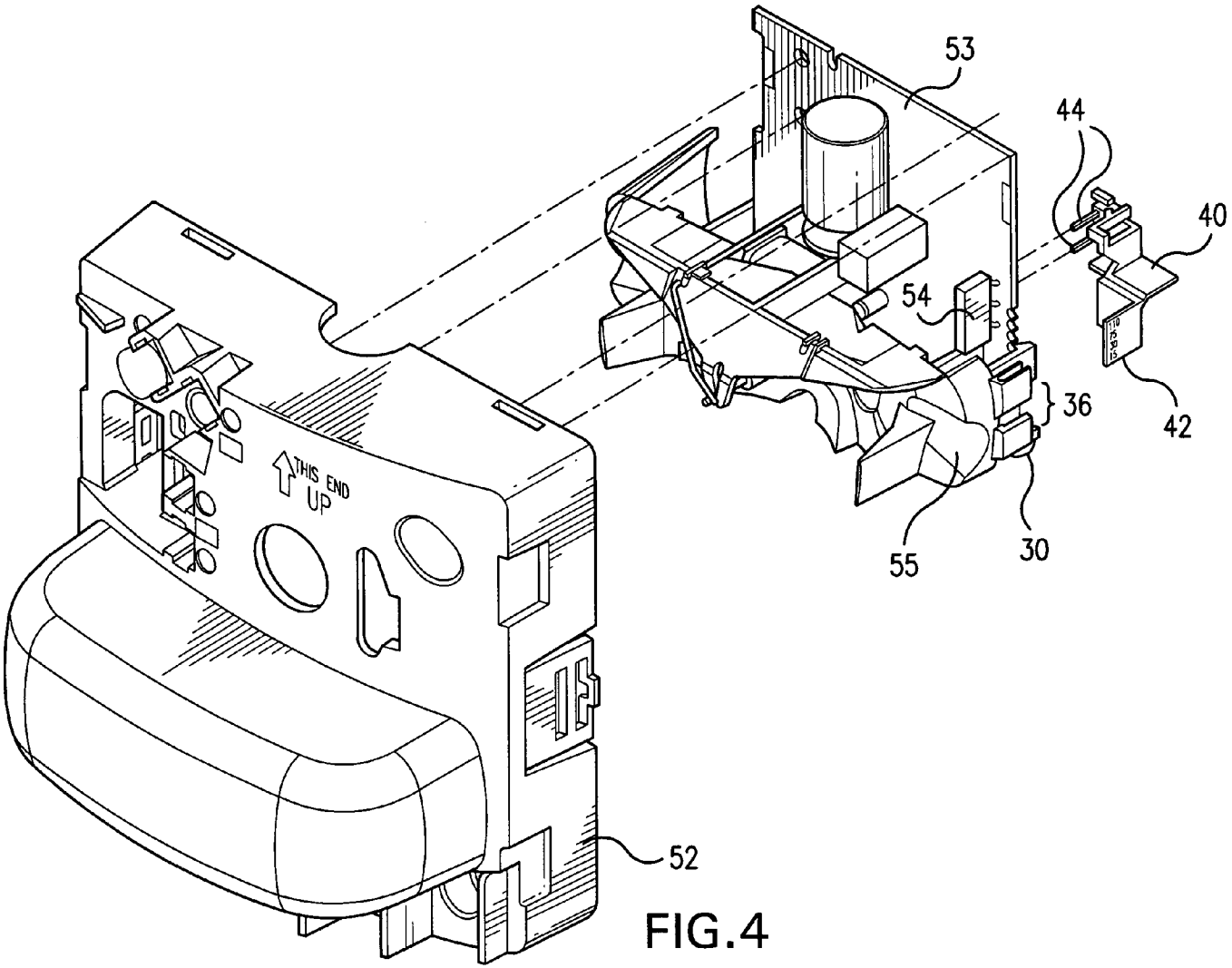
FIG. 4 illustrates some of the components of a strobe-only wall-mount appliance such as that shown in FIG. 1A.

FIG. 4 illustrates some of the components of a strobe-only wall-mount appliance such as that shown in FIG. 1A. The escutcheon is not shown. The transparent housing 52 fits over a circuit board 53, which carries the operating circuitry for the appliance. The reflector 55, which directs light from the strobe bulb (not shown), is mounted to the circuit board 53. One part of the reflector 55 is shaped into a pocket 30 having a solid rear wall and a front wall having a window or strobe intensity viewing slot 36. In the embodiment shown, the pins 44 of the intensity selection plug 40 are inserted through holes in the printed circuit 53 and into a rear-insertion jumper socket 54. The flag 42 of the intensity selection plug 40 is seated in the pocket 30, and the selected intensity is visible through the strobe viewing slot 36.

Figure 5:
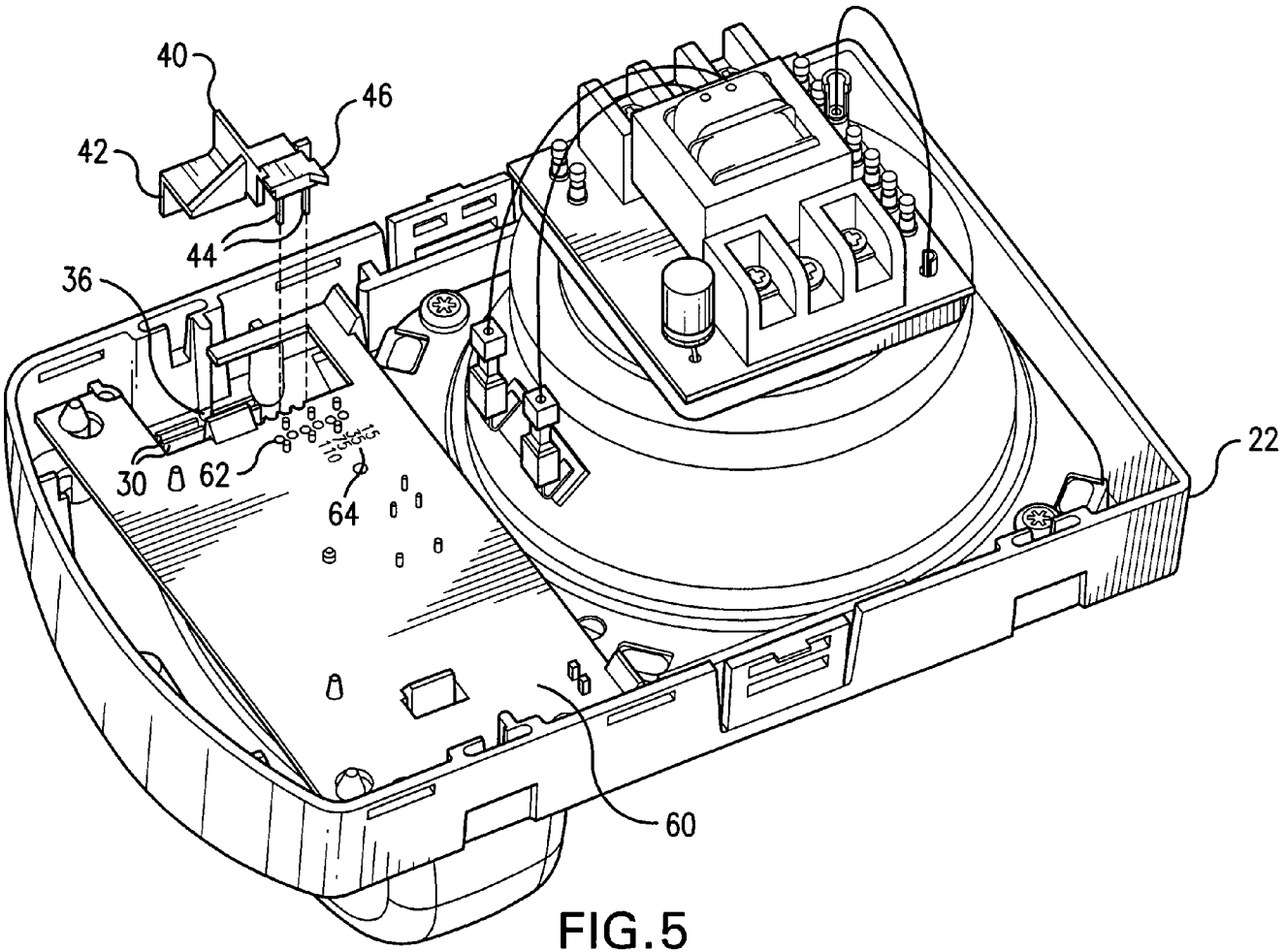
FIG. 5 is an illustration presenting a rear view of the notification appliance of FIGS. 1B and 2.

FIG. 5 is an illustration presenting a rear view of the notification appliance 10B of FIGS. 1B and 2. A printed circuit 60 is mounted to the transparent housing 22. Accessible to the rear of the printed circuit 60 (and accessible only when the appliance 10B is removed from its wall mounting) are a series of holes 62 into which the jumper pins 44 of the intensity selection plug 40 can be inserted. Upon insertion of the plug 40, the plug flag 42 is seated into the pocket 30, such that the selected intensity setting is visible through the strobe viewing slot 36. A list 64 of intensity settings printed on the printed circuit 60, combined with the selection pointer 46 on the plug 40, enable an installer to easily select the desired setting. When the plug 40 is inserted, the selection pointer 46 points to the selected intensity value 64.

Figure 6:
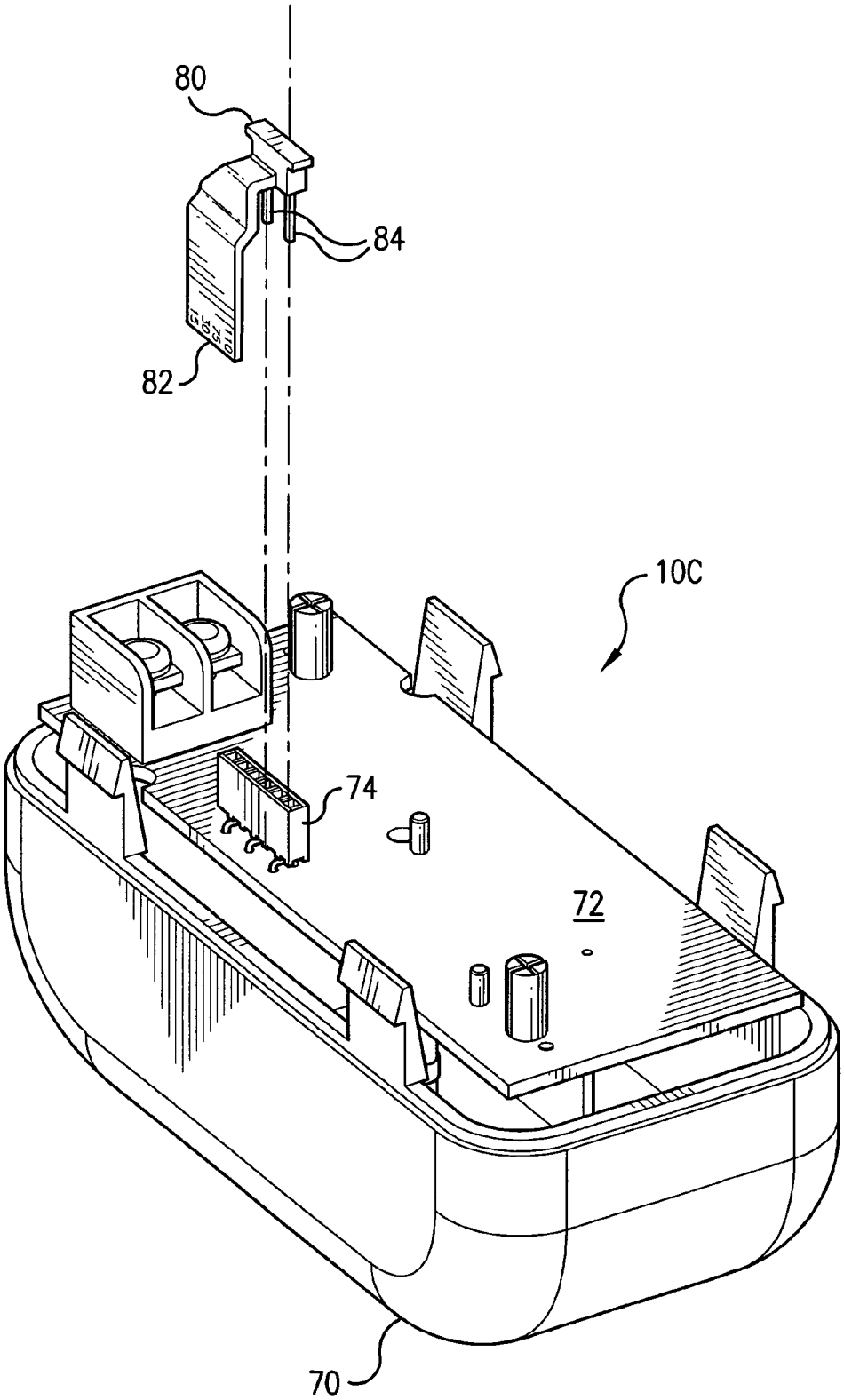
FIG. 6 illustrates an embodiment of the present invention in a ceiling-mount appliance, such as that of FIG. 1C.

FIG. 6 illustrates an embodiment of the present invention in a ceiling-mount appliance 10C, such as that of FIG. 1C. The unit comprises a transparent dome 70 and a printed circuit 72. In this embodiment, the pins 84 of an intensity selection plug 80 are inserted directly into a jumper socket 74, which is mounted on the back side of the printed circuit 72. The flag portion 82 of the plug 80 extends beyond the printed circuit board 72 and is visible through the dome 70.

Figure 7:
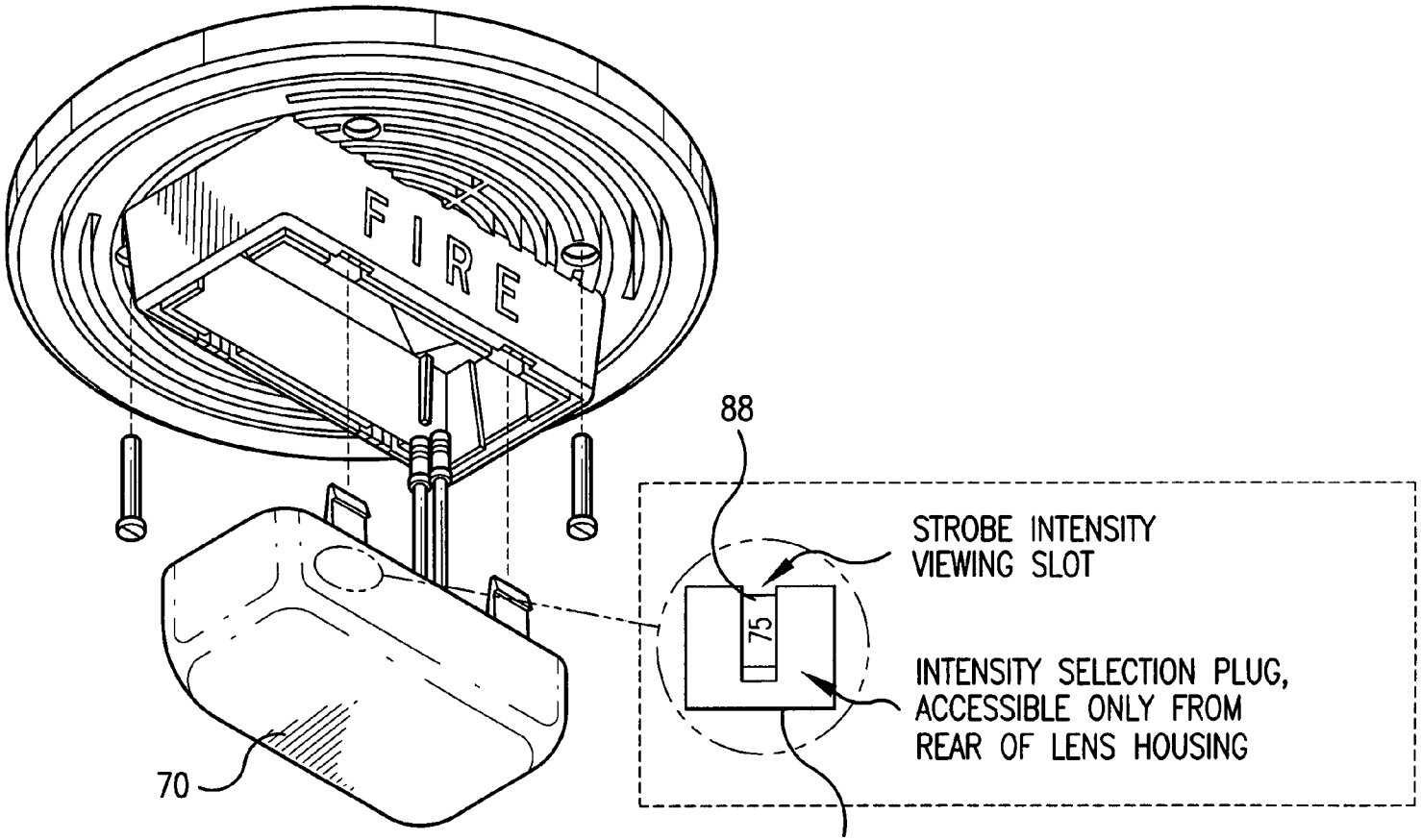
FIG. 7 is an illustration showing how the selected intensity is visible through a slot in the pocket in which the flag of FIG. 6 is seated.

FIG. 7 illustrates how, as with previously discussed embodiments, the selected intensity is visible through a slot 88 in the pocket 86 in which the plug's flag 82 (FIG. 6) is seated.

Other embodiments, while using a jumper or plug to select the intensity, alternatively or additionally use LEDs (or other lamps) or audible signals to indicate the selected intensity. LEDs are preferably mounted where they are visible when the appliance is correctly mounted on the wall or ceiling, as is appropriate. In one embodiment, the LEDs are visible when the escutcheon is in place. Alternatively, an embodiment can be configured such that the LEDs are visible only when the escutcheon is removed.

In one embodiment, for example, multiple LEDs are used to indicate the selected intensity. The intensity can be color coded, using, for example, red, green, white, and yellow to indicate different levels of intensity; or the LEDs can be binary coded so that, for example, two LEDs can represent any of four possible intensities, e.g., where {on/on; on/off; off/on; off/off} represent, respectively, 15, 30, 75 and 110 candela.

In another embodiment, an LED is alternately turned on and off according to a pulse code. For example, the LED can be flashed on once per second to indicate a first intensity, twice per second to indicate a second intensity, and so on. Alternatively, one long pulse can indicate a first intensity, while two short pulses indicate a second intensity, and so on.

Alternatively, multiple LEDs can be aligned in a bar formation (or, more economically, a bar graph LED display can be used) such that the highest (or lowest) LED that is on (or off) indicates the current intensity selection.

Alternatively, LEDs can be placed at different locations on the notification appliance, each LED representing a specific intensity so that the location of an LED that is on indicates the selected intensity.

Seven-segment or other multiple segment displays can also be used to indicate the selected intensity.

The LEDs may activate either a) when the strobe is activated or b) when power is applied to the strobe or c) on command, or any combination of the above.

In yet another embodiment, an audible signal can identify the selected intensity. For example, a horn can be pulsed according to some pattern to identify the selected intensity. Alternatively, a synthesized or recorded voice can state the selected intensity.

In yet another embodiment, different colored resistors or other key components are used to select strobe setting amplitude. The resistors can be dipped in paint, i.e., red, white, blue, yellow, or printed with the values 15, 30, 75, 110 to reflect the intensity setting. During installation the installer selects and inserts the appropriate component. Since the strobe cover is clear plastic, the selected component, and thus the selection, is evident.

Of course, although the examples are limited to four possible intensity settings, it would be understood by one skilled in the art that more or less available intensity settings can be offered in other embodiments.

While this invention has been particularly shown and described with references to preferred embodiments thereof, it will be understood by those skilled in the art that various changes in form and details may be made therein without departing from the scope of the invention encompassed by the appended claims.

What is claimed is:

1. A visual notification appliance, comprising:

a strobe bulb; and a jumper which, by insertion at a particular position of a circuit board, selects one of plural strobe intensities for the strobe bulb, the jumper comprising a pointer portion, said pointer portion, upon insertion of the jumper onto the circuit board, indicating the selected strobe intensity from a list printed on the circuit board.

2. The visual notification appliance of claim 1, the jumper comprising a list of available strobe intensity values inscribed thereon, the visual notification appliance further comprising:

a viewing slot through which the selected strobe intensity value from the jumper list is observable during normal operation of the visual notification appliance.

3. The visual notification appliance of claim 2, the jumper comprising a flag portion, said flag portion having inscribed thereon the list of available strobe intensity values, the flag portion being seated in a pocket upon insertion of the jumper onto the circuit board, one face of said pocket comprising said viewing slot.

4. The visual notification appliance of claim 2, further comprising:

an escutcheon having a dimple through which the viewing slot can be viewed.

5. The visual notification appliance of claim 4, the dimple being displaced from the viewing slot such that the selected strobe intensity value on the jumper flag is observable through the viewing slot when viewed from an angle.

6. The visual notification appliance of claim 1, the jumper being located such that it cannot be tampered with without removing the notification appliance from its mounting.

7. A visual notification appliance comprising:

a strobe bulb;

a jumper which, by insertion at a particular position of a circuit board, selects one of plural strobe intensities for the strobe bulb, the jumper comprising a list of available strobe intensity values inscribed thereon; and a viewing slot through which the selected strobe intensity value from the jumper list is observable during normal operation of the visual notification appliance, the jumper comprising a pointer portion, said pointer portion, upon insertion of the jumper onto the circuit board, indicating the selected strobe intensity from a second list printed on the circuit board.

8. The visual notification appliance of claim 7, the jumper comprising a flag portion, said flag portion having inscribed thereon the list of available strobe intensity values, the flag portion being seated in a pocket upon insertion of the jumper onto the circuit board, one face of said pocket comprising said viewing slot.

9. The visual notification appliance of claim 7, the jumper being located such that it cannot be tampered with without removing the notification appliance from its mounting.

10. A visual notification appliance, comprising:

a jumper which, by insertion at a particular position of a circuit board, selects one of plural strobe intensities, said jumper comprising a flag portion having inscribed thereon a first list of available strobe intensity values, said flag portion being seated in a pocket when the jumper is inserted onto the circuit board, one face of said pocket comprising a viewing slot, and a pointer portion which, upon insertion of the jumper onto the circuit board, indicates the selected strobe intensity from a second list printed on the circuit board, the jumper being located such that it cannot be tampered with without removing the notification appliance from its mounting;

said viewing slot through which the selected strobe intensity value of the jumper flag is observable during normal operation of the visual notification appliance; and an escutcheon having a dimple through which the viewing slot can be viewed, the dimple being displaced from the viewing slot such that the selected strobe intensity value on the jumper flag is observable through the viewing slot when viewed from an angle.

11. A visual notification appliance, comprising:

a jumper which, by insertion at a particular position of a circuit board, selects one of plural strobe intensities;

a selection indicator which indicates the selected strobe intensity, said selection indicator being observable during normal operation of the visual notification appliance; and an off-jumper list of strobe intensity values, the selection indicator comprising a pointer on the jumper which points to an indication of the selected strobe intensity.

12. The visual notification appliance of claim 11, further comprising:

a list of strobe intensity values on the jumper, the selection indicator comprising a slot through which only the selected strobe intensity value is observable.

13. The visual notification appliance of claim 12, further comprising:

an escutcheon having a dimple through which the slot can be viewed.

14. The visual notification appliance of claim 13, the dimple being displaced from the slot such that the selected strobe intensity value is observable through the viewing slot from an angle.

15. The visual notification appliance of claim 11, the selection indicator comprising:

an audible device which audibly identifies the selected intensity.

16. The visual notification appliance of claim 11, the selection indicator comprising:

at least one lamp which visually identifies the selected intensity.

17. The visual notification appliance of claim 11, the jumper being located such that it cannot be tampered with without removing the notification appliance from its mounting.

18. The visual notification appliance of claim 11, said appliance being addressable via a network.

19. A visual notification appliance comprising:

a jumper which, by insertion at a particular position of a circuit board, selects one of plural strobe intensities;

a selection indicator which indicates the selected strobe intensity, said selection indicator being observable during normal operation of the visual notification appliance; and at least one lamp which visually identifies the selected intensity, at least one of pulse-coding, binary coding and color coding being used to identify the selected intensity.

20. A visual notification appliance, comprising:

a jumper which, by insertion at a particular position of a circuit board, selects one of plural strobe intensities; and a selection indicator which indicates the selected strobe intensity, said selection indicator being observable during normal operation of the visual notification appliance, the selection indicator becoming active when at least one of the following conditions occurs:

the strobe is activated;

power is applied to the appliance; and upon a command.

21. A visual notification appliance comprising:

a jumper which, by insertion at a particular position of a circuit board, selects one of plural strobe intensities; and a selection indicator which indicates the selected strobe intensity, said selection indicator being observable during normal operation of the visual notification appliance, the selection indicator comprising a coded component.

22. A method for selecting one of a plurality of strobe intensities in a visual notification appliance, comprising:

inserting a jumper to select a strobe intensity, a flag portion of said jumper with a list of available strobe intensities inscribed thereon being seated in a pocket, one face of said pocket comprising a viewing slot through which only the selected is observable; and verifying selection by viewing the selected strobe intensity value of the jumper flag portion through the viewing slot, the jumper comprising a pointer portion, said pointer portion, upon insertion of the jumper onto the circuit board, indicating the selected strobe intensity from a second list printed on the circuit board.

23. The method of claim 22, the viewing slot can being viewable through a dimple in an escutcheon.

24. The method of claim 23, the dimple being displaced from the viewing slot such that the selected strobe intensity value on the jumper flag is observable through the viewing slot when viewed from an angle.

25. The method of claim 22, the jumper being located such that it cannot be tampered with without removing the notification appliance from its mounting.

26. A visual notification appliance, comprising:

a strobe bulb;

a circuit which strobes the bulb at a selected one of plural strobe intensities; and an escutcheon having a dimple through which an intensity indication of the selected strobe intensity can be viewed.

27. The visual notification appliance of claim 26, the dimple being displaced from the intensity indication such that the intensity indication is observable when viewed from an angle.

28. A visual notification appliance, comprising:

a strobe bulb;

a circuit which strobes the bulb at a pre-selected one of plural strobe intensities; and a selection indicator that actively identifies the selected intensity upon the occurrence of at least one of the following events:

the strobe bulb is activated, power is applied to the appliance, and a command to identify the pre-selected intensity is received by the appliance.

29. The visual notification appliance of claim 28, wherein the selection indicator comprises at least one of:

a horn, a speaker, a lamp, at least one discrete LED, a bar graph, and a multi-segment display.

* * * * *